United States Patent [19]

Yamato et al.

[11] 4,416,471

[45] Nov. 22, 1983

[54] COLOR-DEVELOPING SHEET FOR PRESSURE-SENSITIVE RECORDING SHEET

[75] Inventors: Noboru Yamato; Akira Hasegawa; Ippei Shimizu, all of Tokyo, Japan

[73] Assignee: Jujo Paper Co., Ltd., Tokyo, Japan

[21] Appl. No.: 320,731

[22] Filed: Nov. 12, 1981

[30] Foreign Application Priority Data

Nov. 12, 1980 [JP] Japan ..... 55-158215

[51] Int. Cl.[3] ..... B41M 5/22

[52] U.S. Cl. ..... 282/27.5; 428/330; 428/342; 428/477.7; 428/479.6; 428/514; 428/522

[58] Field of Search ..... 282/27.5; 427/150, 151; 428/320.2, 320.4, 320.6, 320.8, 913, 914, 330, 341, 342, 474.4, 477.7, 479.6, 514, 522

[56] References Cited

U.S. PATENT DOCUMENTS 4,076,887 2/1978 Tsuji et al. ..... 282/27.5
4,234,212 11/1980 Kato et al. ..... 282/27.5

FOREIGN PATENT DOCUMENTS 55-51590 4/1980 Japan ..... 282/27.5

*Primary Examiner*—Bruce H. Hess
*Attorney, Agent, or Firm*—Koda and Androlia

[57] ABSTRACT

A color developing sheet for pressure-sensitive recording sheet containing in its color-developing layer an organic coreactant (color-developing agent), calcium carbonate and acrylamide-modified polyvinylalcohol with this construction the color developing sheet provides very much improved mark formation and improved printability such as high surface strength, rapid ink setting, etc..

16 Claims, No Drawings

COLOR-DEVELOPING SHEET FOR PRESSURE-SENSITIVE RECORDING SHEET

BACKGROUND OF THE INVENTION

1. Field of the Invention

The present invention relates to a pressure-sensitive recording paper, and more particularly to an improvement of the mark formation and printability of the pressure-sensitive recording paper.

2. Prior Art

Generally, a pressure-sensitive recording paper consists of a top sheet (CB) of which the back side is coated with microcapsules, containing colorless or pale colored electron donative leuco dyes desolved in an organic solvent (capsule oil), and of a bottom sheet (CF) which has color developing layer containing electron acceptive color developing agent on its front side.

When the top sheet is laid on the bottom sheet and local pressure is applied on them by handwriting (with a ballpoint pen), or with a typewriter, the capsules to which pressure is applied are ruptured, and the oil in the capsules containing leuco dyes is transferred to the color developing layer, and printed mark is formed by color generating reaction of leuco dyes and coreactants.

The color developing sheet mentioned in this invention is a sheet which has the above color developing layer, including the middle paper (CFB) which is coated with color developing agent on the front side and with capsules on the back side, in addition to a bottom sheet (CF) mentioned above.

In recent years, the demand for the pressure-sensitive recording paper has increased very rapidly with systemization of offices, expansion of the information industry and the spread of computers. As a result, the applications for paper have been diversified, and many different properties have been need with regard to the diversified applications of paper. Not only acquiring vivid recorded images, but the improvement of ink setting of the color developing sheets on which mark forms, are also required in order to adapt to high speed printing of normal ink for characters or lines and desensitizing ink. It is necessary for the color developing layer to absorb and set the normal inks or the desensitizing ink in a very short time, in order to adapt to the high speed printing. Also, stickiness of the printed surface or setting off of printed ink to another paper surface can be prevented by improvement of ink setting speed of the color developing sheets, as a result, high speed printing becomes possible. This is especially important in the case of desensitizing printing, wherein it is required to apply larger amounts of ink than in the case of normal ink printing, so that not only an increase of ink absorbing speed of the color developing layer, but also an increase in the amount of ink absorbance are very necessary in order to accelerate the ink setting. Usually the coating color of the color developing sheet contains electron acceptive color developing agent, with the inorganic pigments, such as kaoline, talc and calcium carbonate or organic pigments, such as urea-formaldehyde resins as fillers. Moreover, latexes and one or more sorts of natural or synthetic aqueous polymers are added in order to fix the above mentioned materials on the sheet. Furthermore, if desired, viscosity adjusting agents and pH adjusting agents and so on can be added. The above coating color is coated on the base paper by a coater and dried. For the purpose of color developing ability advance and ink absorption improvement, many methods for transferring capsule oil efficiently to the color developing sheet have been studied, such as adding some amount of fillers which absorb oil very much in the color developing layer. With regard to these fillers, there are disadvantages in that the adhesion of fillers to the sheet decreases as the amount of fillers increases. Therefore, fillers are picked off from the paper surface during printing, and the fillers adhere to the rubber blanket and scum the printing plate. As a result, practical products cannot be obtained.

One method proposed is to use relatively fine calcium carbonate of which 55% of the particle size distribution is less than 2μ, in Japanese Laid-Open Patent Application No. 28857/1980. However, these finer fillers have a higher specific surface; therefore, the fixing strength will be insufficient, if the usual amount of binder is used, and it becomes impossible to fix the fillers and other materials to the sheets sufficiently. Then the coated materials are easily picked off, and the surface strength of the sheet is insufficient for commercial printing. The surface strength becomes higher, but the mark forming ability at the same time becomes lower. If a larger amount of binder is added as a countermeasure, the desirable result cannot be obtained.

SUMMARY OF THE INVENTION

An object of the present invention is to provide a color-developing sheet which has both improved mark formation and improved printability, such as high surface strength, rapid setting of printing ink, etc.

The above and other related objects can be accomplished by using acrylamide-modified polyvinylalcohol as binder, organic electron acceptive color developing agent and calcium carbonate in the color developing layer thereof.

DETAILED DESCRIPTION OF THE INVENTION

Electron acceptive color developing agents, which are used in the color developing sheets, are inorganic solid acids such as acid clay, attapulgite (mentioned in U.S. Pat. No. 2,712,507), p-substituted phenol formaldehyde polymer (mentioned in Japanese Patent Publication No. 20144/1967), aromatic carbonic acids or their metal salts (mentioned in Japanese Patent Publications No. 1086/1974 and No. 1327/1977), and metal salts of 2, 2 bisphenol sulfonates (mentioned in Japanese Laid-Open Patent No. 106313/1979). In this invention organic electron acceptive color developing agent among those mentioned above are used.

The present inventors found that the mark forming ability, printability and other properties are remarkably improved when calcium carbonate as a filler and acrylamide modified polyvinylalcohol as a binder are used together in the coating color which contains organic coreactants.

The organic coreactants in accordance with the present invention include phenolic substances, such as p-tertiary buthylphenol-formaldehyde condensate, p-phenylphenol-formaldehyde condensate, p-octylphenol-formaldehyde condensate, zinc-modified p-octylphenol-formaldehyde condensate, etc., and organic acid-substances, such as metal salt of 2, 2-bisphenol sulfone, a metal salt of ditertiary buthyl salicylic acid, etc. If desired, these organic coreactants may be used singly or in combination with other coreactants.

Generally, it is suitable to add 5–15% by weight of the organic coreactant per total solids content of the coating color of the color-developing layer.

The reason why the color developing sheet made from the combination of the above mentioned materials is remarkably improved is not clear. However, the inventors observed many gaps made along the piled layers of calcium carbonate particles in the electron-microscope photograph on its surface.

It seems that capsule oil which contains leuco dyes transfers efficiently from the top paper (CB) to the color developing layers owing to the capillary action of these gaps. In this case, acrylamide modified polyvinylalcohol does not damage the above mentioned gaps and fixes the calcium carbonate particles effectively in comparison with other binders. Therefore, excellent mark forming ability is obtained as well as high surface strength. This property of the acrylamide modified polyvinylalcohol increases the dramatic effect in the combination with fine particle calcium carbonate.

The fine and numerous gaps which are made by piling up very fine particles of calcium carbonate absorb and transfer capsule oil effectively and improve the mark forming ability remarkably. The acrylamide modified polyvinylalcohol does not damage these gaps and good mark forming ability can be obtained.

The feature of this invention is that a color developing sheet of excellent quality can be produced by combining calcium carbonate with a suitable binder. More specifically, the acrylamide modified polyvinylalcohol used in this invention can be made by decomposition with alcohol after copolymerization of vinyl acetate and acrylamide.

Adhesive strength and flow property of this compound depends on the average degree of polymerization and content ratio of acrylamide, and the quality of the color developing sheet of this invention is under the influence of them.

The average degree of polymerization of the acrylamide-modified polyvinylalcohol, suited for these products is from 600 to 1700 and more desirably from 800 to 1200 degrees. Adhesive strength decreases and the surface of the color developing sheet cannot be kept at the necessary strength if the average degree of polymerization is too low. On the other hand, the flow property of the coating color containing the coreactant becomes unsuitable and the color developing ability decreases if this average degree is too high. The content ratio of acrylamide in acrylamide-modified polyvinylalcohol is 1–30 mol%, preferably 3–20 mol%, whereby the flow property of the coating color will be suitable and the color developing ability will increase. The amount of acrylamide-modified polyvinylalcohol in accordance with the present invention is determined by the performance, etc. required for pressure-sensitive paper and is not otherwise limited. However, in ordinary cases, it is suitable to add 5–25% by weight of acrylamide-modified polyvinylalcohol per total solid content of the coating color of the color-developing layer. It is possible to use other binders with acrylamide modified polyvinylalcohol if the coating methods are selected suitably.

The viscosity or water retention property of the coating color can be especially improved without decreasing the color developing ability by usage of the oxidized starch, other modified starch (e.g. dialdehyde starch, hydroxymethyl starch, hydroxyethyl starch and carboxymethyl starch), casein, gelatine, methyl cellulose, ethyl cellulose, hydroxyethyl cellulose, hydroxypropyl cellulose, carboxymethyl cellulose, carboxyethyl cellulose, sodium polyacrylate, polyvinylacetate latex. Moreover, it is useful to add small amounts of aldehydes, such as formaldehyde, glyoxal, and glutaldehyde in order to increase water resistance of the color developing sheet.

While calcium carbonate of which the average particle size is less than 3μ, can be used in this invention without trouble, it becomes possible to use calcium carbonate of a smaller particle size due to the use of acrylamide modified polyvinylalcohol together, and the effect obtained by this method is very remarkable. Therefore, it is desirable to use the calcium carbonate of which the average particle size is less than 0.6μ, preferably, less than 0.4μ.

In this invention, both ground and precipitated calcium carbonate can be used; however, precipitated calcium carbonate is more suitable because the distribution of the particle size is sharper.

The particle mentioned in this invention means ground single particles in the case of ground calcium carbonate, and in the case of precipitated calcium carbonate, it means a single particle or aggregate particles from a few to several tens of particles, which change according to the condition of the producing reaction.

Though the size of the aggregate particles of the precipitated calcium carbonate is not specifically limited, usually it is desirable to be less than 5μ at most. Formulation ratio of calcium carbonate is desirable to be 5–20 times as much as the coreactants by solid weight and more than 30% by total solid weight of the coating color. Also, if desired, it is effective to use with calcium carbonate another pigment, such as kaoline, talc, aluminum oxide, aluminum hydroxide, zinc oxide, zinc hydroxide or magnesium corbonate and so on, as supplementary fillers.

The fine and relatively large particles of calcium carbonate can be used together without trouble. The color developer coating color, prepared by the above mentioned method, is coated with 5–6 g/m by solid weight on the base sheet and dried.

The obtaind color developing sheet has high brightness and colored marks develop repidly; terminal color density is very high and a clear mark is formed when the piled set of top sheet (CB) and this sheet is typewritten. Scumming of the rubber blanket and plate of the printing press does not take place when the above-mentioned color developing sheet is printed by using the desensitizing ink after preprinting characters and lines by offset printing. Moreover, offset of preprinted normal ink and desensitizing ink does not take place because the setting of the ink is very rapid; and the printability of the sheet is excellent.

Following is the explanation of the present invention shown by examples.

EXAMPLE 1

Seven sorts of slurries of inorganic pigments were prepared and are shown in Table 1:

TABLE 1

Inorganic Pigment Slurries (a) 60% slurry of precipitated calcium carbonate (TP222HS manufactured by Okutama Kogyo Co.) of which average particle size becomes 2μ by the aggregation of single particles with 0.2μ size was diluted to 33% with water.

(b) 65% slurry of precipitated calcium carbonate of which average particle size was 0.33μ (MP555S manufactured by Maruo Calcium Co.) was diluted to 33% with water.

(c) 70% slurry of ground calcium carbonate of which average particle size was 0.55μ (FC-40 manufactured by Maruo Calcium Co.) was diluted to 33% with water.

(d) 100 weight parts of the ground calcium carbonate powder of which average particle size was 1.8μ (Whiton SSB Red manufactured by Shiraishi Kogyo Co.), 0.4 parts of sodium polyacrylate, and 100 parts of water was mixed and dispersed about 15 minutes by Labomixer. The dispersed slurry was diluted to 33% with water.

(e) 100 weight parts of the precipitated calcium carbonate powder of which average particle size was 2μ (PC, manufactured by Shiraichi Kogyo Co.), 0.5 parts of sodium hexameta phosphate and 100 parts of water was mixed and dispersed about 15 minutes by Labomixer. The dispersed slurry was diluted to 33% with water.

(f)

100 weight parts of kaoline clay powder of which average particle size was 2μ (Kaobrite, manufactured by Thiele Co. in U.S.A.), 0.6 parts of sodium hexameta phosphate and 100 parts of water was mixed and dispersed about 15 minutes by Labomixer. The dispersed slurry was diluted to 33% with water.

(g) The slurry of (f) was ground about one hour in Attritor. The average particle size was 0.5μ.

Fifty weight parts of p-phenyl phenol resin emulsion of which solid was 40% was added to 300 weight parts of the above-mentioned inorganic pigment slurry under agitation, and then the 100 weight parts of 10% solution of acrylamide modified polyvinylalcohol (pc-100, manufactured by Denki Kagaku Kogyo Co., degree of polymerization: 1000, degree of modification by acrylamide: 10 mol%) was added. Then the above prepared color was coated to 40 g/m$^2$ base paper with 5–6 g/m$^2$ coating amount by mayer bar and dried. The color developing sheets made by using (a)–(g) of inorganic pigments slurries are named (1)–(7). The following tests were put to these color developing sheets.

1. Color Intensity

A sheet (NW40T manufactured by Jujo Paper Co., Ltd.) was laid upon the color developing sheet, and this piled set was typewritten by an electric-motive typewriter at constant impact pressure. Color intensity of formed mark was measured at one hour after typewriting.

Brightness of the color developing sheet was measured by Hunter Reflectrometer before and after mark formation by typewriting, and color intensity was calculated in accordance with the following equation:

$$D_t = \frac{I_o - I_t}{I_t} \times 100$$

$I_o$: Brightness before mark formation (%)

$I_t$: Brightness at one hour after mark formation by typewriting (%)

$D_t$: Color intensity (%)

2. Surface Strength

Picking off of coated material was organoleptically evaluating after printing three times on the coated surface of the color developing sheet with offset printing ink whose tack value was 10 (manufactured by Toyo Ink Mfg. Co.), using RI printability tester (made by Akira works).

3. Absorptivity of K&N Ink

K&N ink (manufactured by K&N Laboratory Inc., in the U.S.A.) was spread uniformly on the coated surface of the color developing sheet and then the ink was wiped off with a cloth after two minutes and the absorption of the ink was measured.

Absorptivity of the K&N ink was calculated in accordance with the following equation, after measuring the brightness of the sheets before and after ink application.

$$D_k = \frac{I_o - I_k}{I_o} \times 100$$

Brightness before ink application (%)$=I_o$

Brightness after ink application (%)$=I_k$

K&N ink absorptivity (%)$=D_k$

Test results of example 1 are shown in Table 2.

Coloring developing sheets (1), (2), (3), (4), and (5) of the present invention which combines calcium carbonate and acrylamide modified polyvinylalcohol had high color intensity of formed mark and high ink absorptivity. Moreover, they had superior quality of high surface strength. On the other hand, the color developing sheets (6) and (7) of the reference example which used kaoline clay as filler with the usage of the same binder had high surface strength, but color intensity and ink absorptivity were inferior to the sheets of the present invention. Color developing sheets of the present invention, (1), (2), and (3) which used fine particles of calcium carbonate were expecially superior.

TABLE 2

The quality test of Example 1

| Color developing sheet | Color intensity by typewriting (%) | K&N ink absorptivity (%) | Surface strength | Note |
|---|---|---|---|---|
| 1 | 50 | 42 | good | present invention |
| 2 | 52 | 43 | good | present invention |
| 3 | 48 | 40 | good | present invention |
| 4 | 45 | 36 | good | present invention |
| 5 | 46 | 36 | good | present invention |
| 6 | 42 | 33 | good | reference example |
| 7 | 42 | 32 | good | reference example |

REFERENCE EXAMPLE 1

Coating color was prepared by the same method as example 1 except substituting acrylamide modified polyvinylalcohol in example 1 for styrene-butadiene-latex (Dow Latex 620, manufactured by Asahi-Dow Co., Ltd.), with the same solid weight, and color developing sheets were made as shown in Table 3.

TABLE 3

Color developing sheet of reference example 1.

| Color developing sheet | Used filler | |
|---|---|---|
| (8) | TP222HS | same as (a) |
| (9) | MP555S | same as (b) |
| (10) | FC-40 | same as (c) |

TABLE 3-continued

| Color developing sheet of reference example 1. | | |
|---|---|---|
| Color developing sheet | Used filler | |
| (11) | Whiton55B | same as (d) |
| (12) | PC | same as (e) |
| (13) | Kaobrite | same as (f) |
| (14) | Kaobrite Ground in Attritor | same as (g) |

Test results of the above mentioned color developing sheets tested in the same way as example 1 are shown in Table 4.

In the case of usage of styrene-butadiene latex as binder, color intensity and ink absorptivity was slightly good when the fine particles of calcium carbonate were used in comparison with coarse calcium carbonate of larger particles or kaoline clay, but the surface strength of the sheets was remarkably inferior and it could not be used practically. The color intensity and ink absorptivity of the reference example 1 are much inferior to the example 1 of the present invention and the color developing sheet of the present invention is very superior.

TABLE 4

| Quality test of the reference example 1. | | | | |
|---|---|---|---|---|
| Color developing sheet | Color intensity by typewriting | K&N ink absorptivity | Surface strength | Note |
| (8) | 41 | 32 | inferior | reference example |
| (9) | 41 | 32 | inferior | reference example |
| (10) | 40 | 32 | inferior | reference example |
| (11) | 38 | 30 | good | reference example |
| (12) | 39 | 30 | good | reference example |
| (13) | 39 | 30 | good | reference example |
| (14) | 38 | 30 | good | reference example |

EXAMPLE 2

The following coating color was prepared by the usage of precipitated calcium carbonate (TP222HS) and kaoline clay with solid ratio of 70 to 30, as inorganic pigments, acrylamide modified polyvinylalcohol (pc-100) and oxidized starch (Oji Ace B) as binder, and color developing sheets were made by the same method as example 1.

| Material | Solid content |
|---|---|
| Inorganic pigments (above mentioned) | 100 parts |
| Coreactant | 16 parts |
| Oxydized starch (Oji Ace B) | 16 parts |
| Acrylamide modified polyvinylalcohol (PC-100) | 8 parts |

In accordance with the above formulation, the following coreactants were used for making the color developing sheets shown in Table 5.

TABLE 5

| Color developing sheets of example 2. | |
|---|---|
| Color developing sheet | Used coreactant |
| (15) | p-phenyl phenol resin |
| (16) | 2,2-bisphenol sulfone zinc salt |
| (17) | 3.5-ditertiary butyl salicylate zinc salt |

These color developing sheets were tested by the same methods as in example 1, and the results are shown in Table 6.

Color intensity and ink absorptivity were high, and the surface strength was excellent, without regard to the sort of coreactants.

TABLE 6

| The test results of example 2. | | | | |
|---|---|---|---|---|
| Color developing sheet | Color intensity by typewriting | K&N ink absorptivity | Surface strength | Note |
| (15) | 51 | 42 | good | present invention |
| (16) | 50 | 41 | good | present invention |
| (17) | 55 | 42 | good | present invention |

EXAMPLE 3

The following coating color was prepared by the usage of precipitated calcium carbonate (MP555S) and kaoline clay (Kaobrite) with solid ratio of 75 to 25 as inorganic pigments, and oxidized starch (Oji Ace B) and other binders were used together as binders. Formulation of there materials is in the following.

| Materials | Solid |
|---|---|
| Inorganic pigments (above mentioned) | 100 parts |
| p-phenylphenol resin | 16 parts |
| Oxydized starch (Oji Ace B) | 8 parts |
| Another binder | 8 parts |

In accordance with above formulation following another binders were used for making color developing sheets shown in Table 7.

TABLE 7

| Color developing sheets of Example 3. | |
|---|---|
| The color developing sheet | Another binder |
| (18) | Acylamide modified polyvinylalcohol (degree of polymerization: 1000, degree of modifications: 10 mol %) (pc-100 manufactured by Denki kagaku Kogyo Co) |
| (19) | Acrylamide modified polyvinylalcohol (D.P.: 600, D.M.: 4 mol %) (Np-10K, Denki Kagaku) |
| (20) | Acrylamide modified polyvinylalcohol (D.P.: 600, D.M.: 2 mol %) (Np-15, Denki Kagaku) |
| (21) | Acrylamide modified polyvinylalcohol D.P.: 1700, D.M.: 2 mol %) (Ep-120K, Denki Kagaku) |
| (22) | Polyvinylalcohol (degree of polymerization: 1700, degree of saponification: 99%) (Poval 117 manufactured by Kuraray Co.) |
| (23) | Polyvinylalcohol (D.P.: 1000, D.S.: 99%) (Poval 110 Kuraray) |
| (24) | Polyvinylalcohol (D.P. 500, D.S.: 89%) (Poval |

TABLE 7-continued

| The color developing sheet | Color developing sheets of Example 3. Another binder |
|---|---|
| | 205 Kuraray) |
| (25) | Styseve-butadiene latex (JSR-0668C, manufactured by Japan Synthetic Rubber Co.) |

Test results of the above mentioned sheet made by the same method as example 1 are shown in Table 8. The color developing sheets (18), (19), (20) and (21) wherein acrylamide modified polyvinylalcohol was used together as the binder had the superior qualities. That is, color intensity by typewriting, ink absorptivity and surface strength of the sheets were high.

On the other hand, when usual polyvinylalcohol is used, color intensity and ink absorptivity decreased in accordance with increase of the degree of polymerization, though the surface strength increased. The color intensity by typewriting and ink absorptivity increased, but surface strength decreased in accordance with decrease in the degree of polymerization. Therefore, they were inferior to the color developing sheet of the present invention. The sheets which use styrene-butadiene latex as binder were inferior with respect to all properties and they could not be used practically.

TABLE 8

| Color developing sheet | Test results of example 3 Color intensity by typewriting (%) | K&N ink absorptivity (%) | Surface strength | Note |
|---|---|---|---|---|
| (18) | 51 | 42 | good | present invention |
| (19) | 52 | 43 | good | present invention |
| (20) | 52 | 43 | good | present invention |
| (21) | 49 | 40 | good | present invention |
| (22) | 45 | 36 | good | reference example |
| (23) | 47 | 37 | fair | reference example |
| (24) | 47 | 40 | fair | reference example |
| (25) | 40 | 32 | inferior | reference example |

EXAMPLE 4

Color developing coating color was prepared by using 2, 2-bisphenol sulfone zinc salt as coreactant, acrylamide modified polyvinylalcohol (pc-100) and oxidized starch (Oji Ace B) as the binder while changing recipe ratio of ground calcium carbonate and kaoline clay (Kaobrite) as inorganic pigments as shown in the following Table 9 and color developing sheets were made.

TABLE 9

| Color developing sheet | Color developing sheets of example 4. Ratio of FC-40 and Kaoline | Coreactant | pc-100 | Oji Ace B |
|---|---|---|---|---|
| (26) | 75/25 | 19 | 8 | 8 |
| (27) | 55/45 | 19 | 8 | 8 |

TABLE 9-continued

| Color developing sheet | Color developing sheets of example 4. Ratio of FC-40 and Kaoline | Coreactant | pc-100 | Oji Ace B |
|---|---|---|---|---|
| (28) | 35/65 | 19 | 8 | 8 |

Test results of the above mentioned sheets which were tested by the same method as example 1 are shown in Table 10.

Color developing sheets (26) and (27) wherein ground calcium carbonate of fine particles were used in an amount of more than 30 weight % of total solid had high color intensity and ink absorptivity and excellent surface strength.

Color developing sheet (28) wherein calcium carbonate of fine particles was used in an amount less than 30 weight % was inferior a little in respect to color intensity and ink absorptivity, though superiority of the color developing sheet of the present invention remained.

TABLE 10

| Color developing sheet | Test results of example 4 Color intensity by typewriting (%) | K&N ink absorptivity (%) | Surface strength | Note |
|---|---|---|---|---|
| (26) | 49 | 40 | good | present invention |
| (27) | 47 | 38 | good | present invention |
| (28) | 44 | 36 | good | present invention |

We claim:

1. Color-developing sheet for a pressure sensitive recording sheet having a color-developing layer comprising an organic electronic acceptive color developing agent, calcium carbonate and acrylamide-modified polyvinylalcohol having an average degree of polymerization of 600 to 1700 and containing 1–30 mol% of acrylamide.

2. Color-developing sheet for a pressure-sensitive recording sheet having a color-developing layer comprising an organic electronic acceptive color developing agent, calcium carbonate and acrylamide-modified polyvinylalcohol having an average degree of polymerization of 800 to 1200 and containing 3–20 mol% of acrylamide.

3. Color-developing sheet according to claim 1 or 2, wherein said calcium carbonate has an average single particle size of less than 0.6$\mu$.

4. Color-developing sheet according to claim 1 or 2, wherein said calcium carbonate has an average single particle size of less than 0.4$\mu$.

5. Color-developing sheet according to claim 1 or 2, wherein said calcium carbonate is used in an amount of at least 30% by weight per total solid content of said color-developing layer.

6. Color-developing sheet according to claim 1 or 2, wherein the amount of said calcium carbonate is 5–20 times as much as said organic electron acceptive color developing agent by solid weight.

7. Color-developing sheet according to claim 1 or 2, wherein said color developing layer further comprises another pigment, in addition to said calcium carbonate.

8. Color-developing sheet according to claim 7, wherein said other pigment is at least one member selected from the group consisting of kaolin, talc, aluminum oxide, aluminum hydroxide, zinc oxide, zinc hydroxide and magnesium carbonate.

9. Color-developing sheet according to claim 1 or 2, wherein fine and relatively large particles of said calcium carbonate are contained in said color-developing layer.

10. Color-developing sheet according to claim 1 or 2, wherein said acrylamide-modified polyvinylalcohol is used in an amount of 5–25% by weight per total solid content of said color-developing layer.

11. Color-developing sheet according to claim 1 or 2, wherein said color-developing layer further comprises another binder, in addition to said polyacrylamide-modified polyvinylalcohol.

12. Color-developing sheet according to claim 11, wherein said another binder is at least one member selected from the group consisting of oxidized starch, dialdehyde starch, hydroxymethyl starch, hydroxyethyl starch, carboxymethyl starch, casein, gelatine, methyl cellulose, ethyl cellulose, hydroxyethyl cellulose, hydroxypropyl cellulose, carboxymethyl cellulose, carboxyethyl cellulose, sodium polyacrylate and, polyvinylacetate latex.

13. Color-developing sheet according to claim 1 or 2, wherein said organic electron acceptive color developing agent is at least one member selected from the group consisting of phenolic substance and organic acid substance.

14. Color-developing sheet according to claim 1 or 2, wherein said color-developing sheet comprises another electron acceptive color developing agent in addition to said organic electron acceptive color developing agent.

15. Color-developing sheet according to claim 1 or 2, wherein said color-developing layer is applied with 5–6 $g/m^2$ by solid weight on a base sheet.

16. Color-developing sheet according to claim 1 or 2, wherein said color-developing layer further comprises aldehydes.

* * * * *